United States Patent [19]

Boersma

[11] Patent Number: 4,651,892

[45] Date of Patent: Mar. 24, 1987

[54] CONTAINER AND LID HAVING A LOCKING RING

[75] Inventor: Martinus Boersma, Wormerveer, Netherlands

[73] Assignee: Thomassen & Drijver-Verblifa N.V., Deventer, Netherlands

[21] Appl. No.: 748,048

[22] Filed: Jun. 24, 1985

[30] Foreign Application Priority Data

Jun. 29, 1984 [NL] Netherlands ..... 8402078

[51] Int. Cl.[4] ..... B65D 45/32

[52] U.S. Cl. ..... 220/320

[58] Field of Search ..... 220/319, 320, 321

[56] References Cited

U.S. PATENT DOCUMENTS

| | | | |
|---|---|---|---|
| 2,237,952 | 4/1941 | Smith | 220/321 |
| 2,523,639 | 9/1950 | Tucker | 220/320 |
| 3,079,031 | 2/1963 | Henchert | 220/320 |
| 4,177,934 | 12/1979 | Hammes et al. | 220/319 |

*Primary Examiner*—George T. Hall

*Attorney, Agent, or Firm*—John P. Snyder

[57] ABSTRACT

The invention relates to a container, comprising: a tubular body with at least one open end, wherein a part of the body adjacent to the end is provided with a bent body rim; a cover closing the open end having a cover rim which grips over the bent body rim; and a locking ring encircling the cover rim and the bent body rim which assures against a relative displacement of the cover in relation to the body. In order to lessen the danger of the occurrence of open contact at the end wall portions, for example be dropping, the curled body rim is additionally curled and/or the body is provided with a groove extending over at least parts of the body circumference, on which a part of the locking ring turned away form the open end of the body can support, and/or the locking ring is provided with a release element arranged in and across it.

21 Claims, 19 Drawing Figures

FIG.9
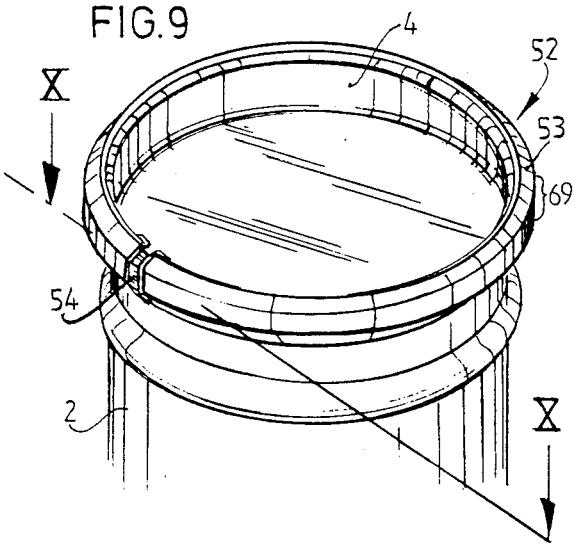
FIG.10
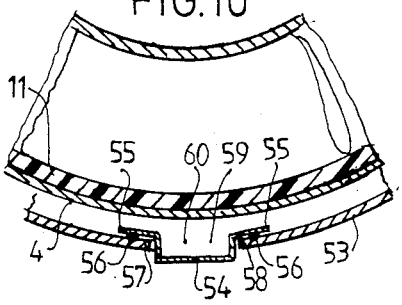
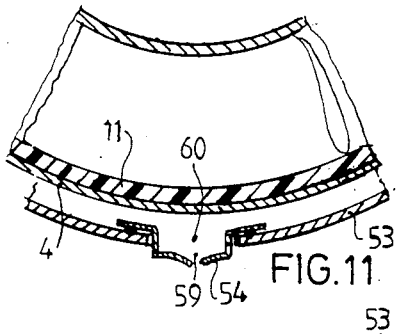
FIG.11
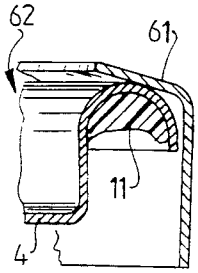
FIG.12a
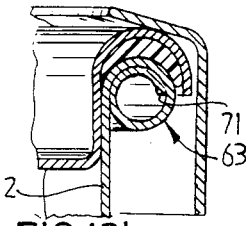
FIG.12b
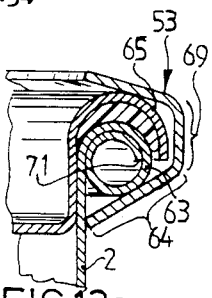
FIG.12c
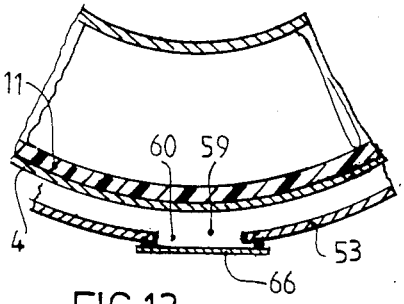
FIG.13
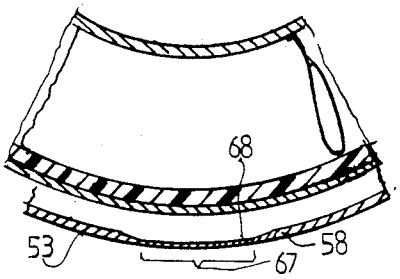
FIG.14

CONTAINER AND LID HAVING A LOCKING RING

The present invention relates to a container, comprising: a tubular body with at least one open end, wherein a part of the body adjacent to the end is provided with a bent body rim; a cover closing the open end having a cover rim which grips over the bent body rim; and a locking ring encircling the cover rim and the bent body rim which assures against a relative displacement of the cover in relation to the body.

This known container has the disadvantage that if forces are exerted in the area of the cover rim, forces which occur for example if the container is dropped, such a deformation of the container results that contact is made between the interior of the container and the environment, so that the content of the container can escape through leakage. As a result of this possible leakage risk, such a container may not be used for the transport of dangerous substances.

The invention under consideration has for its object the improvement of the container of the type already referred to in the sense that the assembly formed by the body rim, cover rim, cover and locking ring acquires such a bending rigidity that the forces affecting the container, for example as a result of it being dropped, lead to deformation in another part of the container where deformation leads less quickly to the occurrence of open contact between the interior of the container and the environment.

As in a first embodiment according to the invention this is achieved in that the curled body rim is additionally curled.

Curling of a body rim involves the bending of a body end until an edge of the bent body rim is directed towards the body (see FIG. 7*b*).

Additional curling of a body rim involves further bending of the end of a curled body rim such that the end wall edge of the body is positioned upward into the curl along the surface of the body and lies against this surface and possibly the interior curl surface. After the additional curling the end wall edge has assumed a position in the curl, with the curl viewed in section, that corresponds to between about 9 o'clock and 3 o'clock according to clock numerals (see FIG. 2, 8, 12*b* and *c*).

As in a second embodiment according to the invention, this is achieved in that the body is provided with a groove extending over at least parts of the body circumference, on which a part of the locking ring turned away from the open end of the body can support. Normally the locking ring is provided with clamping means, a coupling nut, with which the locking ring enclosing the cover is clamped onto the body. This coupling nut is a vulnerable element in the locking ring. As in a third embodiment according to the invention for reducing the vulnerability of the holder already referred to, the locking ring is provided with a release element arranged in and across it.

If the additionally curled body rim is provided with rim parts which generally extend parallel to the body, there is a resulting increase in the height of the previously described assembly, which leads to an even greater bending rigidity across the cover rim.

The bending rigidity can be increased even further, if a cover rim end portion extends over the body rim parts for a distance (c) which is generally greater than half of the curled height (a).

Because the assembly of additionally curled body rim and the over gripping onto it has a greater rigidity, a further significant increase in bending rigidity results from the locking ring having a relatively great ring wall thickness.

If an angle enclosed between an axial face of the tubular body and a supporting face of the groove lies between $-10°$ and $30°$, a groove supporting face is obtained which slopes in relation to the locking ring such that, when the locking ring supports on the groove, there generally occurs no relative displacement between them.

If the locking ring is split and the release element extending over the split is firmly attached to it, a locking ring provided with the release element can be manufactured in a simple manner out of an existing locking ring. If the release element has such a form that a space is enclosed within the split, the locking ring can be split at the height of the release element in a simple manner by inserting a suitable tool into this space and subsequently performing a radial outward movement with it. According to a favourable embodiment, the release element seen in cross section has the form of a bracket. It is on the other hand possible that the release element forms an integral part of the locking ring and that the thickness of the release element is smaller than the thickness of the remaining part of the locking ring.

In addition, the invention relates to the body for a container according to the invention, and a locking ring provided with a locking ring rim, evidently intended to support on a groove arranged in a body, and/or a release element.

Finally the invention relates to an apparatus for manufacturing a body for a container, according to the invention, which is characterized by: a table for bearing the body to be manufactured; and upsetting die, which is relatively movable in the direction towards and away from the table, for the curling of a rim of the body; and an additional curling die cooperating with the upsetting die.

If the length of the path of motion between the upsetting die and the additional curling die is greater than the length of an addionally curled portion of the body rim, a so-called elongated additionally curled rim can be formed.

If the apparatus is characterized by an element for the formation in the body of a groove that extends over at least parts of the body circumference, the groove on which the locking ring can support can also be formed.

If the distance between the groove forming element in a projected position and the additional curling die is generally equal to the thickness of the body wall, the groove is generally encircled by this element and the additional curling die during the curling of the body rim, so that during this operation, no deformation of the groove generally occurs as a result of the forces exerted on the body with the curling die.

If the length of the path of motion between the upsetting die and the additional curling die is greater than the length of an additionally curled portion of the body rim, deformation of the groove or the body part lying between the groove and the body rim can be prevented in another way.

Mentioned and other characteristics will be elucidated on the basis of a number of non-limitative embodiments of the invention, given by way of example and with reference to the annexed drawing.

In the drawing:

FIG. 1 shows a perspective view of a container according to the invention;

FIG. 2–6 each show a section across the line II—II of FIG. 1 of various embodiments of the container according to the invention;

FIG. 7*a*–7*d* show a schematic view of an apparatus for manufacturing a body, as shown in FIG. 2 and 5 respectively;

FIG. 9 shows a perspective view of another embodiment of the container according to the invention;

FIG. 10, 11, 13 and 14 each show a section across the line X—X of FIG. 9; and

Figure 3:
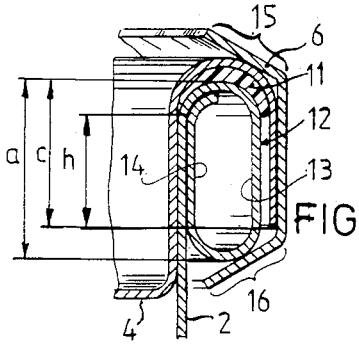

FIG. 12*a*–12*c* are sections corresponding with FIG. 3 which show the arranging on the body of the cover having a locking ring provided with a release element.

Figure 1:
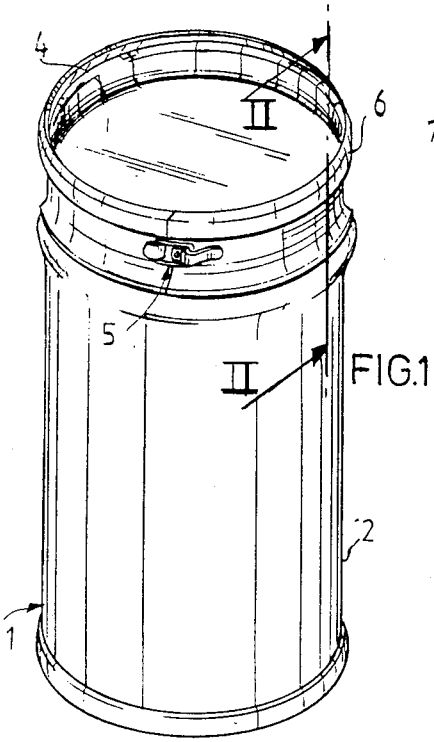

FIG. 1 shows a container 1 according to the invention with a tubular body 2 and cover 4 which closes over an open end 3 of the body 2, and which, using a locking ring 6 provided with clamping means 5, is assured against a generally axial relative displacement in relation to the body 2.

Figure 2:
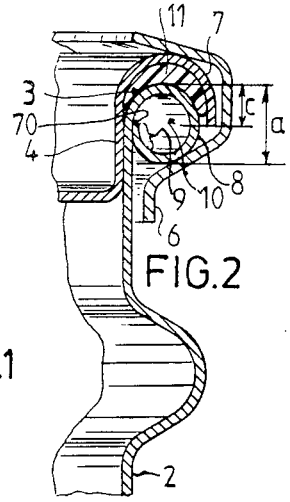

FIG. 2 shows in more detail the construction at the location of the open end 3 of the body 2. A cover rim 7 of the recessed cover 4 grips onto a body rim 8 which is additionally curled. Additional curling implies that, in contrast to, for example, FIG. 4, a portion 9 of the body rim 8 is curled further towards the interior 10 of the curled body rim 8. Between the additionally curled body rim 8 and the cover rim 7 a sealing medium is applied, for example a plastomer. In addition it is clear to see that the locking rim 6 encircles the additionally curled rim 8 and the cover rim 7. The end wall edge 70 is in a position which corresponds to about nine o'clock according to clock numerals.

In the embodiment as shown in FIG. 3 the additionally curled body rim 12 is provided with two rim portions 13 and 14, which generally extend parallel to the body 2. By adding the length h the body rim 12, which in this case is an elongated additionally curled rim, becomes significantly stronger and gains more bending rigidity in a direction across the cover rim 7, which in this case is also elongated, in order to generally encircle the elongated additionally curled body rim 12 completely. The elongated additionally curled body rim 12 is moreover capable of withstanding a higher interior pressure which occurs inside the container 1, because the force exerted on a strip 15 of the locking ring 6 as a result of the interior pressure is transferred via the strip 16 of the locking ring 6 to the elongated additionally curled body rim 12. This latter has, as a result of its additionally curled form, more bending rigidity. N.B. the same applies to the embodiments as in FIGS. 2 and 5.

Because the assembly of locking ring, cover rim and body rim has considerably more bending rigidity, any forces affecting it if it is dropped will only give rise to deformation in the part of the body 2 situated beneath this assembly, where deformation, for example in the form of denting, buckling or wrinkling, leads considerably less quickly to an opening in the body 2.

Figure 4:
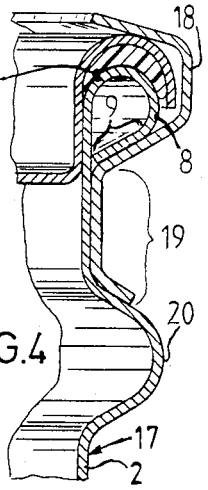

In the embodiment shown in FIG. 4, the container 17 has a known curled body rim 8. In this embodiment the locking ring 18 shows a part 19 turned away form the open end 3 of the body 3, which can support on a groove 20 arranged in the body 2 over its circumference. As a result of the part 19 of the locking ring 18, forces example if it is dropped, are transferred via the part 19 to the groove 20 and absorbed there through the deformation of the body 2. Because the part 19 supports on the groove 20, deformation in the area of the open end 3 is generally prevented.

Figure 5:
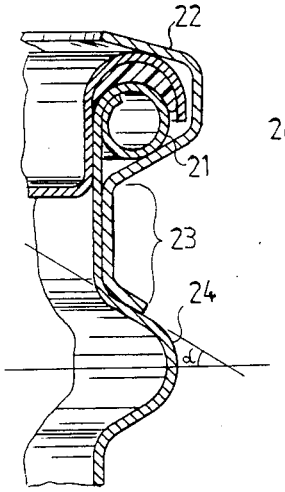

FIG. 5 shows a variant, where a body rim 21 is additionally curled while the locking ring 22 is provided with a part 23 which supports on a groove 24.

Figure 6:
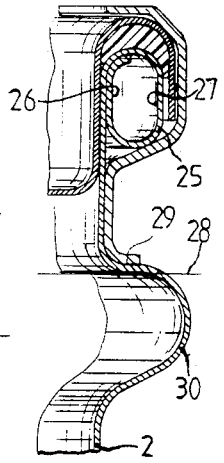

In relation to FIG. 5, the additionally curled body rim 25 in FIG. 6 is further elongated and provided with the parts 26 and 27 which generally extend parallel to the body 2. Also in this case, an angle $\alpha$, enclosed between an axial face 28 and a supporting face 29 of the groove 30, is inherently equal to 0°, while in FIG. 5 the angle $\alpha$ is inherently equal to ca. 30°.

FIG. 7 shows an apparatus 31 for manufacturing a body 2, as shown in FIGS. 2 and 5.

Figure 7A:
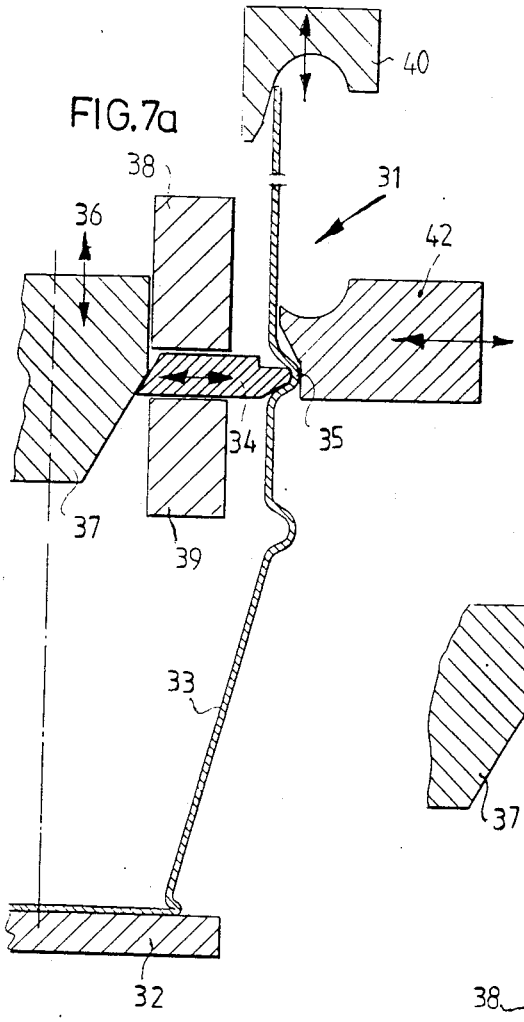
Figure 7B:
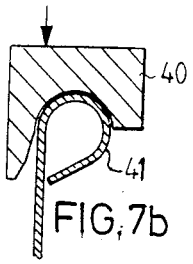
Figure 7C:
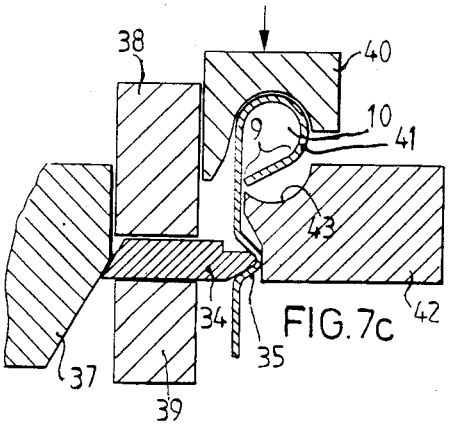

The apparatus comprises a table 32 for bearing the body to be manufactured. Using a groove forming element 34, a groove 35 is arranged in the body 33 by displacing a frustrum conical element 37 in the direction of the arrow, as a result of which the element 34 is pressed radially in an outward direction against the body 33. The element 34 is guided between the guide elements 38 and 29. After the forming of the groove 35, an upsetting die 40 is moved in axial direction towards the table, whereby the body rim is given a curled form, as shown in FIG. 7*b*.

Figure 7D:
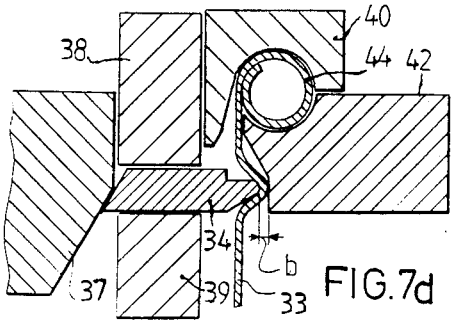

Finally, the formed curl 41 can be additionally curled using an additional curling die 42, because a concave portion 43 of the additional curling die 42 bends the part 9 of the curl 41 towards the interior 10 of the curl 41. The formed additionally curled body rim 44 is shown in FIG. 7*d*. Because a distance b between the element 34 and the additional curling die 42 is inherently equal to the thickness of the body 33, no deformation of the groove 35 can generally occur during curling and additional curling.

Figure 8:
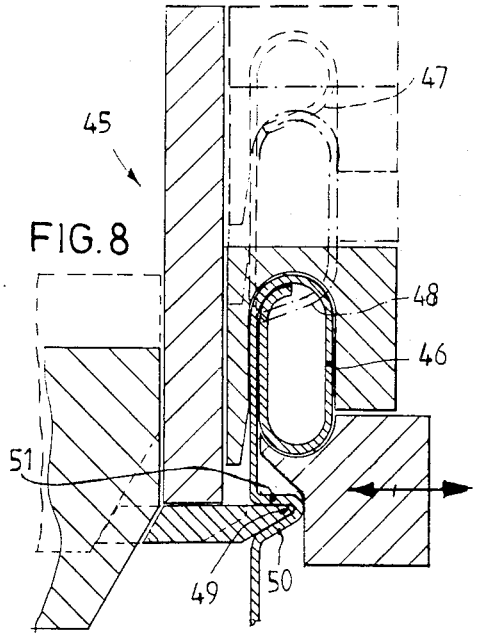
FIG. 8 shows a schematic view corresponding with FIG. 7 of an apparatus for manufacturing a body, as shown in FIG. 3 and 6 respectively.

FIG. 8 shows a similar apparatus 45 for the forming of an additionally curled and also elongated body rim 46. The forming of the curled body rim 47 is indicated using dashed lines, the forming of the elongated curled body rim 48 using dot and dash lines and finally the forming of the elongated additionally curled body rim 46 using full lines. Using the face 49 a supporting face 51 can be given to the groove 50, so that the angle $\alpha$ is equal to 0°.

During additional curling using the additional curling die 42, undesired deformation of the groove 35, 50 and the body portion lying between the groove 35, 50 and the body rim 46 can be avoided if, during additional curling, the additional curling die 42 is moved towards the upsetting die.

FIG. 9 shows a container 52 having a tubular body 2 and a cover 4 closing an open end of the body 2 which using a locking ring 53, is assured against an inherently axial relative displacement in relation to the body 2. The locking ring 53 is provided with a release element 54 arranged in and across it. The release element 54 has the form of a bracket. The feet 55 of the release element 54 are clinker built welded to the split edges 57 and 58 of the locking ring 53, using spot welding. The release element 54 extends over and through the split 59, enclosing a space 60. By inserting a tool, for instance a screwdriver, into this inherently tubular sleeved space 60, and then performing a radial outward movement with its handle, whereby the part of the tool inserted into the space 60 supports against a portion of the body 2 lying beneath it, the release organ 54 can be split open in axial direction from the body 2. In this way the situation shown in FIG. 11 is reached, where as a result of overcoming the spring force, the locking ring 53 remains clamped around the cover 4.

Through the application of the release element 54 the locking ring has become less vulnerable, it can be mounted and firmly connected around the cover of the body 2, but is reasonably simple to split again.

An additional advantage is that an assembly consisting of the cover 4 and a formling 61, from which the final locking ring is formed, is cheap to manufacture in advance and mount on a body 2. FIG. 12*a* shows this assembly 62. The formling 61 has in section an inherently angled form such that the cover 4 is closed up in it, while the assembly 62 can be mounted without interference on the body 2 over the body rim 63 (FIG. 12*b*). A part 64 of the formling 61 is subsequently bent, whereby the cover rim 65 and the body rim 63 are clamped in (FIG. 12*c*). The end wall edge 71 is in a position which corresponds to three o'clock according to clock numerals.

FIG. 13 shows another embodiment of a release element 65, in this case a material strip which is welded onto the split locking ring 53, covering the split 59. The space 60 is also in this case sufficient to allow the insertion of a splitting tool.

In FIG. 14 the release element 67 has the form of a locking ring part of which has a thickness smaller than that of the remaining part of the locking ring, whereby the reduced thickness is preferably located on its concave-convex surface 68 directed to the cover.

The release element according to the invention can extend over the whole height of and between the locking ring. It can be sufficient for the release element to be arranged only along the parallel part 69 on the body surface of the locking ring.

Although only a curl form is shown in the drawings, where the body end is, in the first instance, bent in a radial outward direction, a curl form can also be applied within the framework of the invention, whereby the body end is bent in a radial inward direction. In this last case it is worth recommending the forming of a inwardly directed groove directly under this curl.

I claim:

1. A container comprising the combination of:

a tubular body having an open end presenting an end edge, said body having a curled rim at such open end and said curled rim including a portion adjacent said end edge which extends parallel to and lies against the body and another portion more remote from said end edge which extends parallel to and in spaced opposition to the portion first mentioned;

a cover closing said open end of the body and having a cover rim which grips over said curled rim; and a locking ring encircling said cover rim and the curled rim which assures against a relative displacement of said cover in relation to said body.

2. A container as defined in claim 1 wherein said cover rim extends over said curled rim for a distance which is generally greater than half the height of said curled rim.

3. A container as defined in claim 1 wherein said body is provided with a groove extending over at least parts of the body circumference and said locking ring having a part engaged with and supported by said groove.

4. A container as defined in claim 1 wherein said locking ring is provided with release means.

5. A container as defined in claim 4 wherein said locking ring is split and said release means bridges said split.

6. A container as defined in claim 4 wherein said release means is a weakened portion of said locking ring.

7. A container comprising the combination of:

a metal body of tubular form having a curled rim at one end thereof;

a cover closing said one end of the body and having a peripheral rim embracing said curled rim;

a removable locking ring surrounding said peripheral rim to allow the cover to be separated from the body; and means for protecting the closure between the cover and said curled rim against leakage due to overloading or impact when said locking ring is in place, said means comprising a first portion of the curled rim extending parallel to and in contact with the metal body and a second portion of the curled rim parallel with and in spaced opposition to said first portion.

8. A container as defined in claim 7 wherein said body is provided with an outwardly deformed portion extending circumferentially thereof in spaced relation to said curled rim and said means comprises a portion of said locking ring seated upon said outwardly deformed portion.

9. A container adapted to retain dangerous substances and to resist leakage of such substances due to adverse shipping and handling conditions to which the container may be subjected such as overloading of containers as in stacking thereof or impact forces as in handling thereof, which comprises the combination of:

a tubular metal body having closure means at one end and removable cover means at its other end, said body having a curled rim at said other end and said removable cover means comprising a cover having a circumferential wall fitted within said other end of the body and reinforcing it from within, and a cover rim overlying and embracing said curled rim to provide a removable closure for said other end of the body which is susceptible to potential leakage due to adverse shipping and handling conditions;

removable locking ring means surrounding said other end of the body in removable protecting relation to the removable closure; and additional protecting means for resisting leakage due to adverse shipping and handling conditions.

10. A container as defined in claim 9 wherein said additional protecting means comprises an extended portion of said curled rim which is rentrant within the curled rim to engage the inner surface thereof.

11. A container as defined in claim 9 wherein said additional protecting means comprises a portion of said locking ring means and a deformable portion of said body engaged by said portion of the locking ring means.

12. A container as defined in claim 11 wherein said additional protecting means also comprises a portion of said curled rim engaged by said removable locking ring means and another portion of said curled rim engaged with said body.

13. A container adapted to retain dangerous substances and to prevent leakage of such substances due to adverse shipping and handling conditions to which the container may be subjected such as placing too much load upon a container or subjecting it to destructive impact forces, which comprises the combination of:

a tubular metal body having closure means at one end for maintaining sealed closure at such one end and removable cover means sealingly interfitted with its other end for providing a sealingly interfitted but removable closure at such other end which is inherently susceptible to leakage if damaged due to adverse shipping and handling conditions;

first protecting means for preventing removal of said cover means until such removal is desired so as to prevent leakage at said removable closure incidental to normal shipping and handling; and additional protecting means cooperating with said first protecting means for resisting damage to and consequent leakage at said removable closure due to adverse shipping and handling conditions.

14. A container as defined in claim 13 wherein said other end of the body is provided with a curled edge forming part of said additional protecting means, said curled edge defining a hollow annulus presenting spaced apart inner and outer wall portions with the inner wall portion lying against and in contact with the body, said first protecting means surrounding said annulus and contacting said outer wall portion of the curled rim.

15. A container as defined in claim 14 wherein said additional protecting means comprises a margin of said curled edge which lies against said inner wall portion.

16. A container as defined in claim 15 wherein said additional protecting means also includes a skirt portion on said first protecting means engaging the outer side of said body remote from said other end thereof.

17. A container as defined in claim 16 wherein said outer side of the body is deformed outwardly so as to prevent a weakened portion thereof for absorbing impact and other loads transmitted thereto by said skirt.

18. A container as defined in claim 14 wherein said additional protecting means comprises a skirt portion on said first protecting means engaging the outer side of said body remote from said other end thereof.

19. A container as defined in claim 18 wherein said outer side of the body is deformed outwardly so as to present a weakened portion thereof for absorbing impact and other loads transmitted thereto by said skirt.

20. A container as defined in claim 15 wherein said hollow annulus is vertically oblong.

21. A container as defined in claim 18 wherein said hollow annulus is vertically oblong.

* * * * *